United States Patent [19]

Spees

[11] 4,245,415

[45] Jan. 20, 1981

[54] FILE CARD FOR FILING SYSTEM

[75] Inventor: Arthur T. Spees, Tustin, Calif.

[73] Assignee: Visu-Flex Company, Pico Rivera, Calif.

[21] Appl. No.: 624,065

[22] Filed: Oct. 20, 1975

Related U.S. Application Data

[63] Continuation-in-part of Ser. No. 296,020, Oct. 10, 1972, Pat. No. 3,913,250, which is a continuation-in-part of Ser. No. 883,113, Dec. 8, 1969, Pat. No. 3,785,520, which is a continuation-in-part of Ser. No. 612,202, Jan. 27, 1967, abandoned, which is a continuation-in-part of Ser. No. 328,798, Dec. 9, 1963, Pat. No. 3,301,263.

[51] Int. Cl.[2] ..... B42F 17/00

[52] U.S. Cl. ..... 40/380; 40/372

[58] Field of Search ..... 40/78, 68.6, 360, 104.17, 40/380–384, 360, 379, 359, 372

[56] References Cited

U.S. PATENT DOCUMENTS

| | | | |
|---|---|---|---|
| 834,294 | 10/1906 | Gremple | 40/78 |
| 928,346 | 7/1909 | Vick | 40/78 |
| 1,338,789 | 5/1920 | Rand | 40/78 |
| 1,558,376 | 10/1925 | Lewis et al. | 40/68.6 |
| 2,226,519 | 12/1940 | Larsen | 402/70 |
| 2,371,713 | 3/1945 | Short | 40/360 |
| 2,543,437 | 2/1951 | Claxton | 40/104.17 |
| 3,301,263 | 1/1967 | Spees | 40/360 |
| 3,913,250 | 10/1975 | Spees | 40/78 |

*Primary Examiner*—John F. Pitrelli

*Attorney, Agent, or Firm*—Knobbe, Martens, Olson, Hubbard & Bear

[57] ABSTRACT

A file card for use in a filing system for compact filing of information. Such a system includes a file receptacle for a plurality of the file cards. The cards include fulcrum means adjacent their bottom edges and are normally supported in the file receptacle in substantially vertical positions. However, by manually fanning apart any pair of the file cards at their top edges, the fulcrum means of these and adjacent cards cooperate with one another and with the file receptacle to automatically fan apart the upper portions of file cards adjacent the manually fanned apart cards, thereby making visually scannable the information on the upper portions of such cards. In one embodiment the file cards are merely divider cards, and data cards are inserted between them. In this instance the data cards are supported by a data card support arrangement which is integral with the file receptacle, and holding elements are provided on the file cards to position the data cards against desired ones of the file cards. Various forms of fulcrum means, holding elements, file card spacers and file card configurations are disclosed.

43 Claims, 21 Drawing Figures

FILE CARD FOR FILING SYSTEM

CROSS-REFERENCES TO RELATED APPLICATIONS

This application is a continuation-in-part of my copending application Ser. No. 296,020, filed Oct. 10, 1972 now U.S. Pat. No. 3,913,250; which is a continuation-in-part of my application Ser. No. 883,113, filed Dec. 8, 1969, now U.S. Pat. No. 3,785,520, which is a continuation-in-part of my application Ser. No. 612,202, filed Jan. 27, 1967, now abandoned, which is a continuation-in-part of my application Ser. No. 328,798, filed Dec. 9, 1963, now U.S. Pat. No. 3,301,263.

BACKGROUND OF THE INVENTION

1. Field of the Invention

This invention relates to file cards for filing systems to enable compact storage of data such as printed material, microfilm, microfiche and the like, and particularly to file cards of this type which include easily visually scannable portions for rapidly identifying and isolating desired data for high speed retrieval.

2. Description of the Prior Art

Various types of visible index filing systems are known in the prior art which are adapted to store data and which utilize file cards having printed data on them, or microfilm jackets and microfiche which incorporate the data. Many are characterized by a high density filing capability and by means to enable rapid identification of desired data for retrieval of information from the system. Such identification is provided in a title area of each file card, and some systems are designed so that the title area of each card is visible at all times. One such uses file cards which themselves carry the data or information, such cards being hinged in flat trays, with from 3/16" to ¼" of each individual file card exposed by overlapping the cards within the trays. This has the obvious disadvantage that the number of file cards that can be filed in a given space is limited by the requirement that they be overlapped. Thus a typical hinged type visible file requires approximately 23 linear inches to file 69 standard file cards. As will be seen, the file cards of my invention permit filing of over 350 file cards in a 16 inch space.

In some instances the file card does not itself carry the desired data. The file card usually carries some indicia, but it becomes essentially a fanning or divider card to permit access to an associated microform card or microfiche which carries the data. The indicia on the file card typically requires approximately ½" of space at its top, and this area sometimes includes coding data to identify the associated microfiche or the like. Sometimes the file cards include paper panels defining pockets to receive the microfiche. Prior art systems for filing such microfiche include one which displays 15 microfiche cards, therefore requiring 7½" of space for title display. The microfiche are carried on 8½"×11 inch panels which are mounted in notebooks. Sometimes such panels are mounted side-by-side around a central column.

Other microfiche files of the prior art employ individual clear plastic jackets to hold the microfiche, with the jackets being contained in multiple-ring binders. Here again, the visibility of each title area is dependent upon overlapping or offset filing of each fiche or jacket.

In each of the above-mentioned prior art systems title area display is achieved at the expense of using valuable linear file space.

One successful prior art vertical filing system is described in U.S. Pat. No. 3,301,263, issued to Arthur T. Spees.

Another type of prior art vertical filing system is a magnetic type in which thin steel wafers or metal inserts are sandwiched between two pieces of paper sealed together ot form the file cards. These metal inserts react with permanent magnets located on the sides of the file tray to cause individual cards to separate or fan apart. This system achieves compact filing, but true or full visibility of individual cards is limited due to the lack of control over the separation of cards. In the reference area, where the "V" is created, for example, as many as 25 cards may be separated or fanned within a 3½" span. The result is that only the very top edge of each card can actually be viewed and, since one-quarter inch is required for a one-line title and one-half inch for microfiche titles, the visible feature of the magnetic file is limited.

As will become apparent from the description of the invention which follows, the disadvantages of the previously described prior art systems are overcome due to the highly novel and unique design of the file cards and file receptacle of my invention.

The system of my invention not only allows extremely high density filing of fully protected file cards, but, at the same time permits rapid information-retrieval. Rapid retrieval is made possible by a unique mechanical interaction among the file cards within the file, whereby the individual file cards can be caused to separate or fan apart at their top portions when their bottom edges are urged together. This mechanical interaction is made possible by a protuberance or protuberances defining a fulcrum extending laterally across each file card near its bottom edge. The fulcrums serve as pivot axes around which the file cards can pivot when their bottom edges are urged together. To control this pivotal action the file cards are provided with hold down portions for engaging the file in such a manner that they are forced to pivot around the fulcrum when their lower edges are urged together. These hold down portions permit the cards to move freely longitudinally, but eliminate relative vertical movement.

Prior art patents which represent the closest art known to applicant and which clearly demonstrate the novelty of applicant's invention as described and claimed herein are the following

| Patentee | No. | Issue Date |
|---|---|---|
| Brower | 769,855 | Sept. 13, 1904 |
| Gremple | 834,294 | Oct. 16, 1906 |
| Carver | 1,053,009 | Feb. 1913 |
| Kouba | 1,073,248 | Sept. 16, 1913 |
| Dayton | 1,250,568 | Dec. 1917 |
| Gebser | 1,730,069 | Oct. 1, 1929 |
| Vance | 1,801,943 | Apr. 21, 1931 |
| Strassel | 1,835,678 | Dec. 8, 1931 |
| Herz | 1,931,224 | Oct. 17, 1933 |
| Copeland | 2,169,318 | Aug. 15, 1939 |
| Wurzburg | 2,171,105 | Aug. 29, 1939 |
| McDermott | 2,284,586 | May 26, 1942 |
| Jonas | 2,329,201 | Sept. 14, 1943 |
| Short | 2,371,713 | Mar. 20, 1945 |
| Pierce | 2,630,219 | Mar. 1953 |
| Wassell | 2,687,732 | Aug. 1954 |
| Dahl, Sr. | 2,954,032 | Sept. 1960 |

-continued

| Patentee | No. | Issue Date |
|---|---|---|
| Dahl, Jr. | 3,465,460 | Sept. 1969 |

SUMMARY OF THE INVENTION

It is an object of the invention to provide a file card for use in a visual index filing system. The cards are generally planar or flat and, are receivable within a file receptacle, one behind the other. The cards can be precisely separated or fanned apart through mechanical interaction to provide complete visibility of the title area of selected ones of the cards.

It is another object of the invention to provide a novel file card adapted for use with similar file cards in a file container or receptacle, and in which each file card includes hold down means cooperative with hold down portions of the file receptacle. Each card further includes outwardly protruding, laterally extending fulcrum means defining a pivotal axis, the fulcrum means of each file card being adapted to cooperatively engage the next adjacent file card to provide a fulcrum for pivotal movement of that card when the lower portions of the file cards are urged together.

It is another object of the invention to provide a novel file card of the aforementioned character in which the file card hold down means is in the form of locking notches located adjacent the bottom of the side edges of the file card. These notches permit the file card to freely pivot on hold down portions mounted to or integral with the file receptacle adjacent the base of the file receptacle.

It is another object of the invention to provide a novel file card of the aforementioned character in which the fulcrum means is in the form of a laterally extending protrusion or series of protuberances. In other embodiments of the invention the fulcrum means takes other forms, such as embossments or protuberances. These enable the file cards to be fanned apart for easily viewing title areas and for refiling in the same place any file card or associated data card which may be removed from the file receptacle.

It is another object of my invention to provide, in a filing system of the character described, a file card including spacing means for spacing the card away from an adjacent file card a distance sufficient to receive a data card therebetween. Such a data card is then accessible when the file cards between which it is disposed are fanned. The term "data card" is a generic term which refers to any data element, microfilm, microfiche, envelope, or the mechanical equivalent thereof. The term "file card" is used herein to denote a card which can itself carry data or, in some embodiments of the invention, a card used as a fanning, back-up, or divider card, with "data cards" sandwiched between such file cards.

Another object of the invention is to provide a file card which is resiliently flexible within the receptacle, the file card further having fulcrum means adapted to cooperatively engage the next adjacent file card in a manner allowing pivotal movement of such file card about the fulcrum when a number of such file cards are urged together adjacent their lower edges. It is also an object to provide a file card having spacing means for evenly spacing apart a plurality of such cards in a file receptacle to allow lines or other indicia on the front upper faces of the file cards or data cards to be clearly visible across the top of the grouped cards. This enables the cards to be related visually to information, schedules or indicia provided at the front, back or intermediate portions of the file receptacle.

Another object of the invention is to provide a file card in which there is minimum surface friction between it and an adjacent file card during operation or movement of the file cards in the file receptacle.

These and other objects of my invention are achieved by a novel file card having a generally flat body and having hold down means cooperative with hold down portions of a file receptacle for holding the file card within the receptacle, the file card further having fulcrum means adapted to cooperatively engage the next adjacent file card in a manner allowing pivotal movement of such file card about the fulcrum when a number of such file cards are urged together adjacent their lower edges.

Other objects and features of the invention will become apparent from consideration of the following description taken in connection with the accompanying drawings.

DESCRIPTION OF THE PREFERRED EMBODIMENTS

Figure 6:
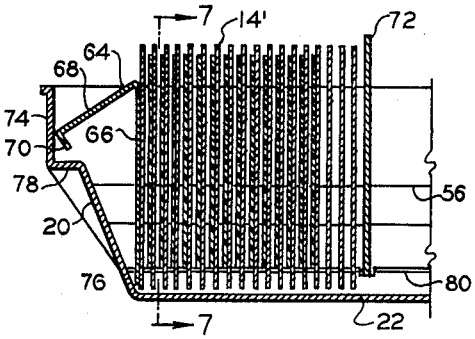
FIG. 6 is a foreshortened elevational cross-sectional view of the forward portion of the system in a storage mode, with the file cards in upright positions.
Figure 7:
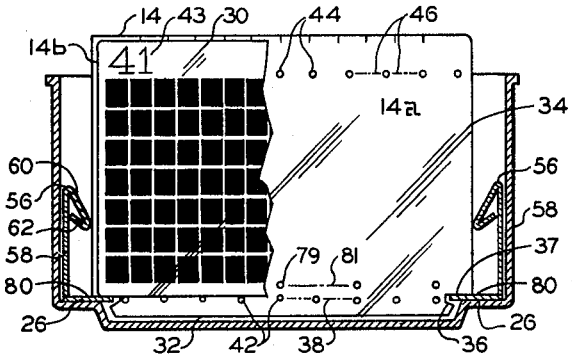
FIG. 7 is a view taken along line 7—7 of FIG. 6.

Referring now to the drawings and more particularly to FIGS. 1, 2, 6 and 7, the numeral 12 generally designates a file container or receptacle of box-like form for holding a plurality of file cards 14*a*. The receptacle 12 is shown as having longitudinal side walls 16, a rear wall 18, a front wall 20 and a bottom wall 22. A cover (not shown) may be provided if desired. As best seen in FIG. 7, side walls 16 have offset sections forming longitudinally extending, generally horizontal shelf-like portions 26. These portions 26 support a pair of locking members 80, the purpose of which will subsequently be described.

The embodiment of the file card 14*a* shown in FIGS. 1 through 7 is not provided with any substantial data but instead serves as a backing, fanning or divider card for an associated data element or card 14*b*. The data cards 14*b* are illustrated in the form of microfiche, but they could take other forms such as film sheets or similar data displaying elements. In other embodiments of the present invention the file card 14*a* itself may include imprinted data, in which case a separate data card 14*b* would not be used.

Figure 3:
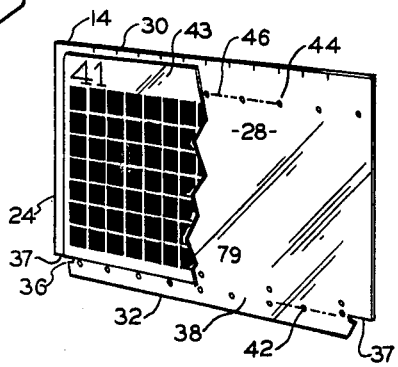
FIG. 3 is a perspective view of one form of file card, the file card in this instance serving as a file divider for an associated data card in the form of a sheet of film or microfiche which is partly broken away to illustrate the manner in which it is associated with the file card.

As illustrated in FIGS. 3 and 7, the file cards each have a planar or flat body 28 and top, bottom and side edges 30, 32 and 34 respectively. The file cards 14*a* are preferably constructed of a resiliently flexible material so that when the body 28 is flexed and released it springs back to its original flat shape and has no tendency to remain curved, that is take a set. By way of example, I have found that plastics such as so-called "rigid" polyvinyl or polyester sheet material are particularly suitable for the file card 14*a*.

As best shown in FIG. 7, th side edges 34 are offset near their bottom extremities to conform to the offset side walls 16 of the receptacle 12. Provided in the region of the offset are oppositely disposed receptacle engaging or hold down means in the form of notches 36, each having a horizontally oriented upper edge 37 extending laterally to intersect the adjacent side edge 34. The notches 36 cooperate with the receptacle locking members 80 to pivotally support each file card 14*a* within receptacle 12 in substantial vertical alignment with adjacent file cards 14*a*.

Figure 4:
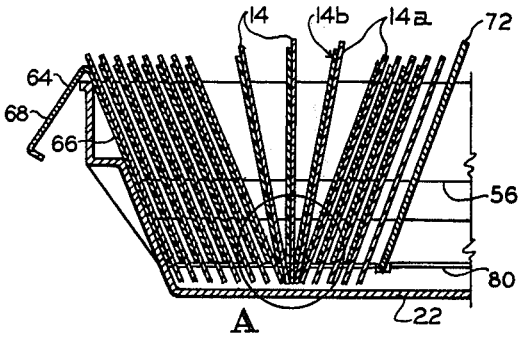
FIG. 4 is a foreshortened elevational cross-sectional view of the forward portion of the system in a data retrieval mode, illustrating the file cards fanned apart.
Figure 5:
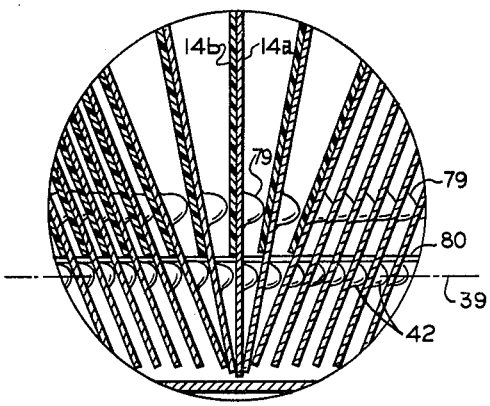
FIG. 5 is an enlarged view of area "A" of FIG. 4; showing the cooperative relation between the fanned apart file cards.

Proximate the bottom edge 32 of each file card are fulcrum means adapted to cooperatively engage the body 28 of the adjacent file card 14*a* to enable pivotal movement of the adjacent file card about such fulcrum means when the file cards are caused to converge at an angle at their bottom edges, in the manner shown in FIGS. 4 and 5. The fulcrum means protrudes outwardly from the flat body 28 of the file card 14*a* and extends laterally thereof in a region designated by a line 38 located adjacent the edge 37, and parallel to and spaced above the bottom edge 32. In the embodiment illustrated in FIG. 7, the fulcrum means comprises a plurality of protuberances 42 distributed in substantially evenly spaced relationship along line 38 from one side of the body 28 to the other.

Figure 8:
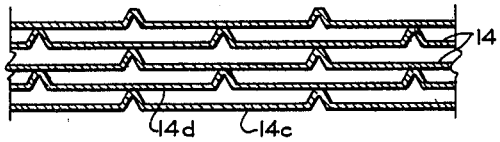
FIG. 8 is a transverse cross-sectional view of a group of file cards in the file receptacle as they would appear in the absence of longitudinal compression.
Figure 9:
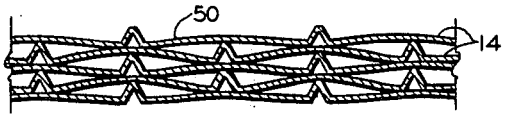
FIG. 9 is a view similar to FIG. 8, illustrating the cards as they would appear when under longitudinal compression.

The fulcrum means may take the form of protuberances formed by the addition of material to the file card, or they may be formed by embossing the file card. When formed in the latter manner, as shown in FIGS. 8 and 9, different embossing patterns are used on adjacent file elements to eliminate nesting which would occur with a single aligned pattern.

The fulcrum means spaces apart adjacent file cards 14*a*. This enables removable data cards 14*b* to be inserted between the file cards 14*a*, as best seen in FIG. 5. Uniform spacing of the file cards 14*a* is also accomplished by spacing means in the form of a plurality of protuberances 44 similar in configuration to the protuberances 42. At least one row of protuberances 44 is provided on each file card 28 along a line adjacent the top edge 30 and substantially parallel to the line 38 of protuberances 42. One row of protuberances 44 are illustrated in FIGS. 3 and 7, but additional protuberances or rows of such protuberances, and varied spacing therebetween, may be provided for certain applications. Varying the spacing will vary the compression force required to compress the file cards 14*a*, as seen in a comparison of FIGS. 8 and 9.

Like the size of many of the elements shown in the drawings, and particularly the detail drawings, the size of the protuberances has been exaggerated in the drawings to facilitate illustration. By way of example, when the file card 14*a* has a thickness of on the order of 0.010 inches, I have found that protuberances having a height of anywhere from two to five times the thickness of the card perform quite satisfactorily both as spacing and pivoting or fulcrum protuberances.

Figure 14:
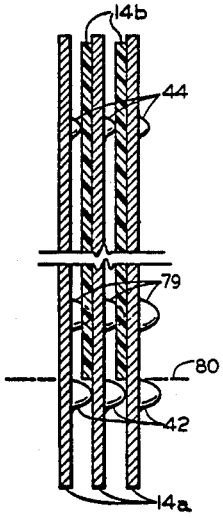
FIG. 14 is a view similar to FIG. 5, but illustrating an exemplary group of the file cards in their upright or storage mode positions, and foreshortened form to include the upper portions thereof.

In those instances in which the file cards 14*a* serve as backing or divider cards for use in association with data cards 14*b* the height of the protuberances 44, that is, the distance they project form the face of the associated card 14*a*, is less than the height of the protuberances 42. Preferably the height of the protuberances 44 is the height of the protuberances 42, less the thickness of the data card 14*b*, as best seen in FIG. 14. With this arrangement the cards 14*a* are maintained in generally uniformly spaced relation at all points.

The protuberances 42 and 44 in the embodiment of the invention illustrated are formed in the body 28 of the file card 14*a* by embossing or the like, and thus a dimple is formed on the front face of each file card 14*a* coincident with the protuberances of the rear face thereof.

As previously mentioned, adjacent file cards 14*a* are provided with fulcrum 42 and spacing protuberances 44 which do not register. Thus, referring to FIGS. 8 and 9, it will be seen that on the foremost file card, designated 14*c*, the protuberances are intermediate those of the next adjacent card, designated 14*d*. It is only necessary to have two patterns of protuberances to accomplish this, with the cards arranged alternately in the file. The two pattern types can readily be differentiated by a suitable marking or difference in shape, such as by having an upper corner portion alternately square and rounded, or by otherwise coding the card.

Preferably, the embossed pattern is such that the protuberances of one file card are disposed substantially midway between the protuberances of the adjacent card. With this arrangement maximum compression of a group of of the file cards can be obtained, as shown in FIG. 9. When the cards are compressed the portions of each file card between the individual protuberances are resiliently deformed to form arches 50 over the protuberances of the next adjacent file card, and the entire group of compressed cards thus becomes spring loaded. Consequently, when the compressing force is released, the cards spring back to their original position, as shown in FIG. 8. It will be apparent that the size, number, position and spacing of the protuberances are factors upon which the compressibility of the individual file cards depends.

In the form of the invention shown in the drawings the file cards 14*a* are restrained from raising out of place in the receptacle container, and there is also contact along the fulcrum means. Contact along the fulcrum line combined with the hold down means for preventing the file cards from being raised out of place contributes to the fanning action described in this application. A slight pressure between the file cards 14*a* is desirable to maintain positive contact between the cards to achieve good fanning.

By reason of the spacing of the file cards 14*a*, the front surface of each card adjacent its top edge 30 is visible, and consequently this area may be provided with indicia such as vertically oriented, laterally spaced lines or the like. In this way cards 14*a* can be related visually to information, schedules or indicia provided at the front, or back or other parts of the file receptacle, which expedites retrieval of desired information.

Figure 12:
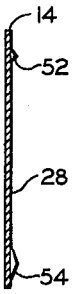
FIG. 12 is a view taken along line 12—12 of FIG. 11.

In the construction thus far described I have shown an embossed pattern of what may be termed dimpled protuberances or projections. However, I contemplate that any means which will provide small protuberances on the surface of a file card may be used, and it is not essential that the card be embossed. Also, other patterns or means for spacing the file cards may be used. For example, as illustrated in FIG. 12, the fulcrum means and file card spacing means may take the form of elongated, resilient or yieldable elements such as strips of plastic material 52 and 54 affixed, preferably permanently, to the body 28 of the file card 14*a*. The strips 52 and 54, as well as other forms of fulcrum means and spacing means will be described in more detail subsequently.

Referring now to FIG. 7, for the purpose of centering a group of file cards 14*a* in the receptacle 12, which is of greater internal width than the width of the cards, I provide a guide or centering means in the form of side guide elements 56 located at each side wall 16 of the receptacle 12. Each element 56 has a thin, flat body 58 having a downwardly inclined section 60 at its upper edge and a terminal, upwardly inclined section 62 at the base of the section 60. The guide elements 56 may be metal or plastic but the material should have resiliency or spring quality. The guide elements 56 serve to center and align the file cards 14*a*, being placed in slight compression by the side edges 34 of the cards 14*a*, as seen in FIG. 7. The downwardly inclined sections 60 serve to guide the file cards into place as they are inserted into the receptacle 12.

The guide elements 56 generate minimum friction with the file cards 14*a*, it is easy to move an entire group of file cards back and forth without abrasion to the side edges 34. The guide elements 56 are particularly useful in visually indexed files where precise lateral alignment of the file cards is essential.

As best seen in FIG. 6, at the front of the receptacle 12 is a front panel 64 made of rigid sheet material having a main planar body 66 provided at its upper edge with a forwardly extending, downwardly inclined flange 68 which terminates in a depending lip 70.

FIG. 6 shows the normal storage position of the file receptacle 12 and its contents, with the front panel member 64 and the file cards 14*a* in upright positions. The file cards 14*a* are compactly held in position between the front panel member and an adjustable end plate or panel 72 which is adjustably positionable longitudinally of the file receptacle 12. The front wall 20 of the receptacle 12 is provided with an upright portion 74 and a sloping portion 76 interconnected by a generally horizontally extending step-like element 78. With the file in a storage mode, front panel member 64 is positioned within the container 12 so that depending flange 68 is in engagement with the inner wall of upper portion 74 of panel 20. In this position, with the front and rear panels in a vertical orientation, the file cards 14*a* are held generally vertically within the container.

By moving the front panel 64 and rear panel 72 into the positions shown in FIG. 4, the forces tending to hold the file cards 14*a* in vertical positions are relieved and the cards 14*a* can be fanned apart where desired. This fanning of a section of the file cards at an area of interest causes adjacent file cards to also fan apart as their lower extremities are urged together. As best seen in FIG. 5, this convergence of the lower extremities of the cards causes the tops of the cards within the fanned group to pivot about their fulcrum means, in this case the protuberances 42, of adjacent file cards, with the result that the file cards fan apart at their upper edges into the positions shown in FIGS. 2, 4 and 5.

Various types of front and rear panels can be used to alternately hold the file cards 14*a* vertically within the file receptacle 12, in a storage mode, or release them for fanning, in a retrieval mode. Also the front and rear panels could be eliminated and the file receptacle 12 provided with integral sloping front and rear walls.

Figure 1:
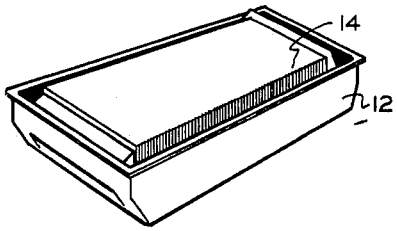
FIG. 1 is a perspective view of a filing system showing a filing receptacle with file cards according to the present invention contained therein as they would appear in a storage mode.
Figure 2:
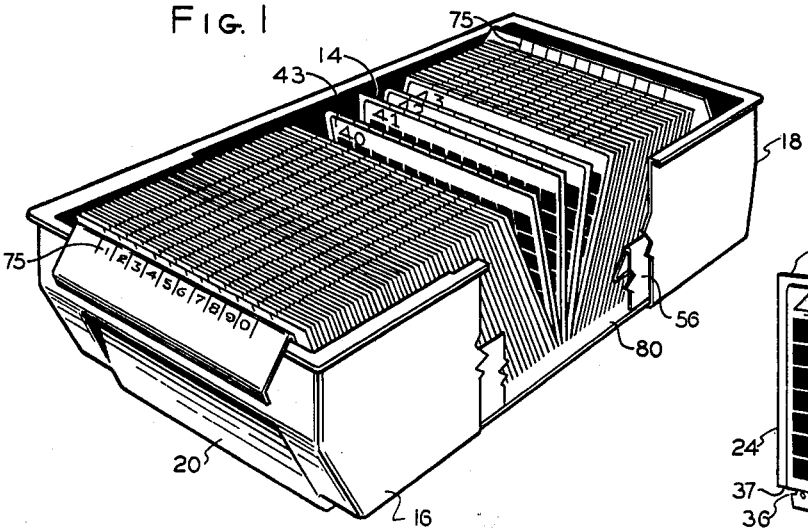
FIG. 2 is an enlarged perspective view of the filing system with the file cards illustrated as they would appear in a data retrieval mode.

As shown in FIG. 2, the front and rear panel members can be provided with indicia 75 relating to indicia on the file cards, or on intermediate spacers, to facilitate location of desired file cards.

The file cards are releasably locked or held in the file receptacle 12 by the cooperative interaction of the hold down means or notches 36 of the cards and hold down portions of the receptacle 12. As shown in FIG. 7, such portions are in the form of the pair of longitudinally extending locking strips or members 80 which protrude inwardly from the receptacle side walls 16 a distance sufficient to extend into the notches 36. The members 80 also support the cards for pivotal movement. In this regard, members 80 are positioned to support the cards 14*a* so that their lower edges 32 are spaced above the receptacle bottom wall 22 for unobstructed pivotal movement relative thereto.

With the construction illustrated, the horizontal center line of the fulcrum means or protuberances 42 preferable is generally coincident with or slightly below the level of the locking members 80, as best seen in FIG. 5, and the file cards 14*a* freely pivot thereon.

As shown best in enlarged FIG. 5, where data cards 14*b* are utilized, such cards 14*b* rest on the members 80 and are thereby prevented from slipping downwardly between the fulcrum protuberances 42. In the embodiment illustrated, such interposition of the data cards 14b between the protuberances 42 and adjacent file cards 14a would disturb the functioning of the fulcrum system. That is, it would alter the pressure of contact between the file cards 14a and the protuberances 42. Also, with the data cards 14b resting upon the members 80, the cards 14b are readily removable upon fanning apart of the file cards 14a. Thus, the members 80 comprise a support for the file cards 14a, the data cards 14b, and also constitute a hold down means for the cards 14a. It is noted, however, that in some applications the data cards 14b and the receptacle 12 could be constructed to permit the data cards 14b to drop below the fulcrum means. This arrangement has been found to be practicable; although not as effective.

The locking members 80 permit the file cards 14a to move freely longitudinally of the receptacle 12 but prevent vertical or lateral movement of the cards. Various forms of card hold down portions other than the members 80 can be used, as will be apparent. For convenience they would be integral or attached to the receptacle side walls 16 but such hold down portions could also take the form of a rod or pair of rods (not shown) extending longitudinally of the receptacle 12 and extending through suitable holes (not shown) provided in the file cards 14a. If a pair of such rods were utilized they could also serve as a support for the bottom edges of data cards 11b. when such cards 11b are utilized.

Figure 13:
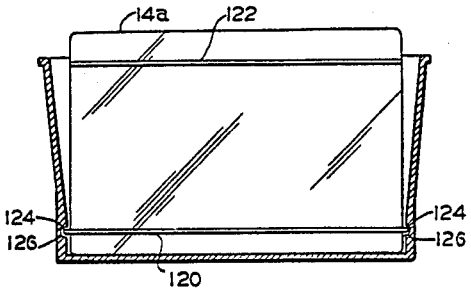
FIG. 13 is a transverse cross-sectional view of yet another form of file card and file receptacle, the file card and receptacle being from the rear.

FIG. 13 illustrates a file card 14a in which the fulcrum means constitutes a continuous ridge or thickened portion 120 adjacent the bottom edge, and the spacing means constitutes a similar thickened portion 122 adjacent the top edge. Such portions 120 and 122 could be made of plastic material suitable adhered to the rear faces of the file cards 14a. In this regard, it will be apparent that a complemental strip or thickened portion could also be adhered to the opposite faces of the cards 14a, if desired, to form a fulcrum extending through the plane of the card. Moreover, it will also be apparent that such portions 120 and 122 could be formed integrally, of the material of the card 14a, if desired.

Figure 16:
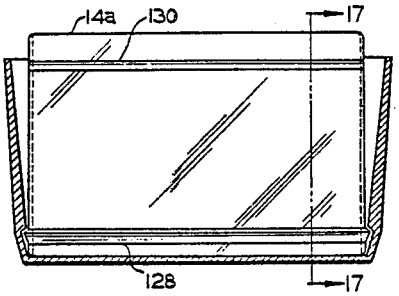
FIG. 16 is a transverse cross-sectional view of yet another form of file card and file receptacle, the file card being of the general type shown in FIG. 12, and file card and receptacle being viewed from the rear.

Preferably the portion 120 extends laterally of the side edges of the card 14a to form hold down means in the form of pivot tabs 124 which are longitudinally slidably received within receptacle hold down portions defined by longitudinal recesses 126 formed in the receptacle side walls. The recesses 126 allow pivotal movement of the cards 14a. In such an embodiment if data cards 14b are to be used, a different form of fulcrum and spacing means would be used, as will be described in conjunction with FIGS. 16–21, to permit the cards 14b to drop down past the fulcrum means to rest on the bottom wall of the receptacle, as seen in FIG. 16.

Returning to the embodiment of FIG. 5, the number of file cards 14a which can be included in the fanned apart group depends upon the thickness of the fulcrum means, or amount of its protuberance, and also the location of the fulcrum means relative to the bottom of the card. Greater thickness causes greater fanning apart, as does closer spacing of the fulcrum means to the bottom edge 32 of the file card 14a.

In FIGS. 1 through 7, the removable data cards 14b are shown in association with the file cards 14a. It is desirable to provide a holding means for holding the data cards 14b against the front faces of the adjacent file cards 14a where they will be in position to be readily identified. Otherwise the data cards 14b may undesirably adhere to the rear faces of the file cards 14a, which would then require the user to tediously peel back or separate the various data cards 14b for identification. Such undesirable adhesion is particularly troublesome where the data card 14b is a glossy film or microfiche.

One form of holding means is illustrated in FIGS. 5 and 7 and comprises a plurality of protuberances 79 formed on each file card 14a along a line 81 substantially parallel to and spaced above the horizontal lines 38 and 39, respectively, along which the protuberances 42 are generally disposed. As previously mentioned, the data cards 14b rest upon the locking members 80. Consequently, the protuberance line 81 is preferably also located above the upper surface of the locking members 80 so that the protuberances 79 will engage the data cards 14b adjacent their lower edges to firmly hold them against the forward faces of the adjacent file cards 14a.

Figure 15:
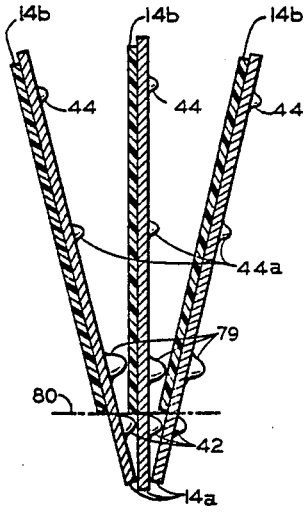
FIG. 15 is a view similar to FIG. 14, but illustrating the file cards in fanned-apart positions.

As best seen in FIGS. 5 and 14, the protuberances 79 are larger than the protuberances 42 which form the fulcrum means and therefore press against and grip the lower portions of the data cards 14b. The resilience of the data cards 14b and file cards 14a allows them to deflect between the protuberances 79 to thereby accommodate the larger size protuberances 79. The protuberances 79 are preferably spaced apart laterally a greater distance than the fulcrum protuberances 42 to allow appreciable deflection. Consequently, the protuberances 79 space the adjacent file cards 14a apart a distance comparable to that provided by the protuberances 42 and 44, whereby the file cards 14a tend to be uniformly spaced apart throughout their surface areas. In this regard, auxiliary spacing means or protuberances 44a may be provided adjacent the side edges 34 of the file cards 14a, as best seen in FIG. 15.

When data cards 14b in the form of microfiche are associated with the file cards 14a, it is important that the spacing protuberances 44, and 44a if used, and the holding protuberances 79 be located in areas of the cards 14a outside or outwardly of the data bearing portions of the microfiche to avoid scratching or otherwise marring the film. Also, as previously indicated, the height of the spacing protuberances 44 would be less than the height of the fulcrum protuberances 42 to compensate for the thickness of the data card 14b.

The file cards 14a, once fanned apart as illustrated in FIGS. 2, 4 and 5, remain in open positions despite removal of one of the data cards 14b. This clearly marks the exact spot for refiling of the card, thereby eliminating any need for a marker or "out card." Insertion and removal of individual file cards 14a is accomplished by slightly bowing or bending the resilient file card material to foreshorten its width enough to permit it to be disengaged from the receptacle hold down portions, such as the members 80.

Various other hold down means can be provided on the file cards 14a. Some protrude from the sides of the card, such as the tabs 124 of FIG. 13. Moreover, although in most instances the cards 14a are supported with their lower edges 32 above the bottom wall 22 of the receptacle 12, as in FIG. 7, the cards could pivotally rest on the bottom wall 22, as seen in FIG. 13.

Figure 10:
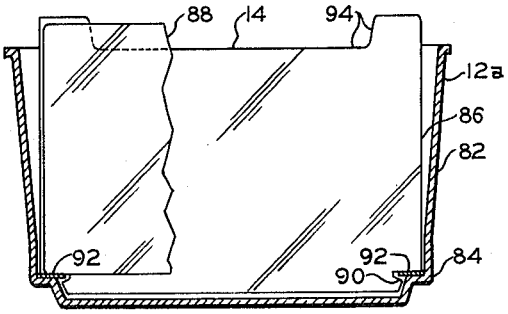
FIG. 10 is a transverse cross-sectional view of another form of file card and file receptacle.

Another form of my invention is illustrated in FIG. 10. In this embodiment the file receptacle 12a is provided with stepped side walls 82, but the width of the container in the region of the stepped portion 84 is only slightly greater than the width of the file cards 14a. The receptacle 12a is formed so that the side walls 82 slope slightly outwardly from the stepped portion 84 and thereby serve to guide the file cards 14*a* into position within the receptacle 12*a*. With this construction centering means or side guides are eliminated, and the side walls center the file cards.

Referring to FIG. 10, the file card is of slightly different design, being intended to serve as a backing or divider card for a data card 88. File card 86, like the previously described file cards, is provided with notches 90 in its side edges which cooperate with receptacle locking strips 92 to hold the card 86 within the container. The card 86 includes a cut out portion 94 adjacent its upper edge to expose the title area of the associated data card 88. This configuration of card 86 permits easy removability of the data card 88, while at the same time supporting the upper corners of the sometimes flimsy data card 88.

Figure 11:
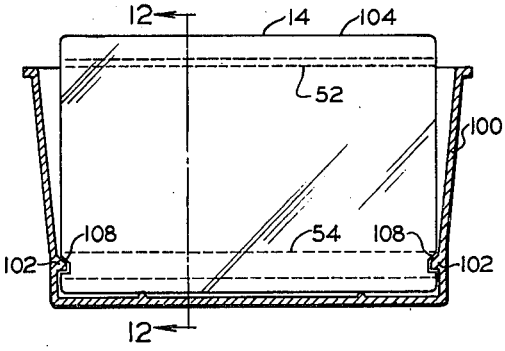
FIG. 11 is a transverse cross-sectional view of still another form of file card and file receptacle.

FIG. 11 shows still another form of the invention in which the receptacle side walls 100 slope directly outwardly from the receptacle bottom. The stepped portions of the receptacle side walls are eliminated in this form of the invention. Instead, the side walls 100 include inwardly protruding support means in the form of a pair of longitudinally extending rib portions 102 formed integral with the receptacle side walls 100. The width of the receptacle is such that the receptacle side walls in the region of the rib portions 102 center the file cards, thereby eliminating any need for separate side guides.

The file card 14*a* of FIG. 11 includes hold down means in the form of notches 108 in the lower side edges. The notches 108 are shaped to cooperate with the rib portions 102 to hold the file cards in alignment within the receptacle. In this embodiment the file cards 14*a* rest upon the bottom of the receptacle 12 and pivot relative to the rib portions 12.

From the foregoing it will be apparent that the present file cards 14*a* are uniquely adapted to be separated or fanned apart to achieve excellent title area visibility. In those embodiments in which the file cards 14*a* themselves carry data, their title areas are successively displayed during the fanning operation, and the hold down means on such file cards simultaneously constrains the cards against undesirable upward vertical movement.

In those instances in which the file cards 14*a* serve as back-up or divider cards for associated data cards 14*b*, the operation of the file cards 14*a* is essentially similar to their operation when they themselves constitute the data bearing element. However, for use with data cards 14*b* the cards 14*a* are preferably provided with the holding protuberances 79. These protuberances and the spacing protuberances 44 are both important in the case of microfiche and the adjacent file card 14*a*. That is, the protuberances 44 and 79 separate the microfiche data cards 14*b* from the rearward faces of the file cards 14*a*, where they would be hidden from view, and the protuberances 79 tend to constantly press the cards 14*b* against the forward faces of the file cards 14*a*. The resulting constant contact between the cards 14*a* and 14*b* during use of the filing system, and the accompanying slight sliding action of the cards 14*a* and 14*b*, tends to develop a static charge which causes the cards 14*b* to adhere to the forward faces of the cards 14*a*. Such a disposition of the cards 14*b* makes the title area of each card 14*b* easily visible when the file cards 14*a* are fanned apart. That is, the cards 14*b* are held in display against the surfaces of the file cards 14*a* facing the viewer.

Once a microfiche data card 14*b* is pressed against the forward face of the associated file card 14*a* by the holding protuberances 79, the molecular attraction between the microfiche card 14*b* and the file card 14*a* is useful in maintaining the card 14*b* against the forward face of the associated file card 14*a*, even at extreme angles of forward tilt of the card 14*a* during a fanning operation. Such an angle of forward tilt is illustrated by the leftmost card 14*a* in FIG. 15. This effect can be further enhanced by making the file cards 14*a* out of a material characterized by a glossy, well-polished surface. Such a surface, in slidable, underlying relation to a glossy microfiche data card 14*b*, is productive of the desired attraction of the surfaces for one another.

As previously indicated, the fulcrum means and spacing means utilized on file cards 14*a* for association with data cards 14*b* may also take the form of the resilient or compressible strips 52 and 54 illustrated in FIG. 12. This type of fulcrum means and spacing means has important advantages over the non-compressible fulcrum and spacing means exemplified by the protuberances 42 and 44.

Compressible types of fulcrum means and spacing means permit the grouped filed cards 14*a* and data cards 14*b* to be compressed to a much greater extent for compact storage. The fulcrum and spacing means are sufficiently resilient that they can be compressed flat, and thereafter spring back to their original shapes when the compression is relieved. This is not possible with the incompressible protuberances 42 and 44.

Another important advantage of compressible fulcrum means is that data cards 14*b* can be inserted downwardly and beyond the pivot axis of the fulcrum means without adversely affecting the pivoting action of the file cards 14*a* about the fulcrum means. Consequently, the compressible fulcrum means can also serve as a hold-back means to hold the data card 14*b* against the forward face of the associated file card 14*a*, and a separate hold-back means, such as the protuberances 79 of FIGS. 5 and 14, can be eliminated.

Referring now to FIGS. 16 through 21, other forms of compressible fulcrum means and spacing means are disclosed.

Figure 17:
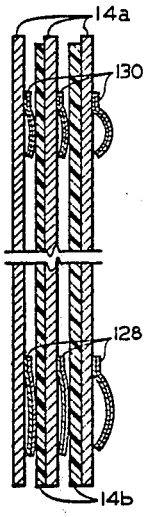
FIG. 17 is a view taken along the line 17—17 of FIG. 16, and illustrating an exemplary group of file cards in their upright or storage mode positions.

The fulcrum means of FIGS. 16 comprises a strip 128 located adjacent the lower edge of the file card 14*a*, and the spacing means comprises a smaller but similar strip 130 located adjacent the upper edge of the card. FIG. 17 illustrates these strips both in their compressed and in their uncompressed states.

Figure 20:
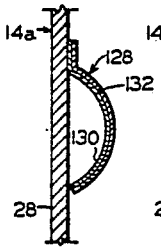
FIG. 20 is a view similar to FIG. 19, but illustrating another form of fulcrum means.

FIG. 20 is an enlarged showing of only the strip 128, but it will be understood that the construction of the strip 130 is identical. As will be seen, the strip 128 is a combination of a strong, semi-rigid, dimensionally stable material and another material which is flexible and shrinks under heat so that the strip 128 is characterized by the curvature illustrated.

However, other material may be used to form the strip 128, if desired, and the materials and methods of fabrication described in the present application are only presently preferred embodiments. The important considerations in constructing the ideal strip 128 are to select a material or materials which have dimensional stability, good adhesion to the file card material, and an elastic "memory" or resilience such that resumption of its curved, uncompressed state quickly occurs, even after being pressed flat in a file system for many months or years. These properties could be present by virtue of the property of a unitary material selected for the strip 128, they could result from a lamination of various materials, or they could result from selective crimping, bending or other deformation of the selected material or materials.

Figure 18:
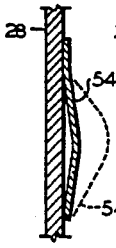
FIG. 18 is an enlarged view of the fulcrum means of FIG. 12 in a compressed state.
Figure 19:
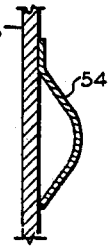
FIG. 19 is a view similar to FIG. 18 but illustrating the fulcrum means in an uncompressed state.
Figure 21:
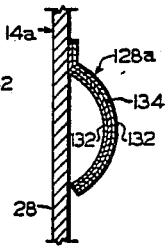
FIG. 21 is a view similar to FIG. 19, but illustrating yet another form of fulcrum means.

FIGS. 18 and 19 are representative of use of a unitary material, in this case a strip 54 of dimensionally stable polyester film approximately 0.005 to 0.010 inches in thickness, which is adhered at its upper portion to the card body 28. The thickness of the materials can be varied to control the strength, flexibility, and durability of the fulcrum means or strip 54. In addition, the card body 28 may be made of any suitable material, but in this embodiment is made of polyvinylchloride material. To facilitate such adhesion the polyester film has a thin coating of chemically treated polyethylene material. In this regard, the particular bonding temperatures and pressures utilized in fabricating the fulcrum means and spacing means of FIGS. 18 and 19, or of FIGS. 20 and 21, are not a part of the present invention. Optimum parameters of heat and pressure, suitability of solvents and adhesives, and compatibility of the materials to be bonded are well known to those skilled in the art and therefore details thereof are omitted for brevity.

Referring now to FIG. 20, the strip 128 is laminated from a layer 130 of polyvinylchloride (PVC) and a layer 132 of dimensionally stable, semi-rigid polyester material. The polyester layer 132 is, like the layer 54 of FIGS. 18 and 19, treated with a coating of another material. As is well known to those skilled in the art, the coating is usually polyethylene or the like with a surface treatment of a chemical bonding agent to render the PVC compatible for bonding with the polyester layer 132. The PVC layer 130 is a pre-stretched, heat shrinkable material. The pre-stretching is preferably uni-directional so that after laminating to the layer 132 under heat and pressure and cooling on a curved form, the layer 132 will be constrained to remain in the curved form by the stresses developed by the heat shrunk layer 130. The direction of these stresses would be essentially uni-directional, in a generally vertical direction, in the plane of the strip 128, as viewed in FIG. 20.

The flexible shrink film is sealed to the semi-rigid dimensionally stable polyester film while in its stretched state under heat and pressure over a form of the desired curvature and set in this curve by chilling or cooling. This shrink film, when subjected to heat in the sealing process, tends to return or shrink to its original pre-stretched dimension and pulls the semi-rigid, dimensionally stable sheet into the desired curved form. A permanent tension is thereby set up to maintain the desired "spring back" quality of the fulcrum from a flattened to a curved state.

The embodiment of FIG. 21 is similar to that of FIG. 20, in this case the fulcrum means comprising a strip 128*a* comprising an inner polyethylene layer 134 sandwiched between a pair of outer layers 132 of dimensionally stable, semi-rigid polyester film. The polyester layers 132, like the polyester strip 54 of FIG. 18, is coated with a polyethylene material, and it is this polyethylene material which forms the internal layer 134 when the outer layers 132 are brought together on a curved form and laminated under heat and pressure.

To facilitate bonding of the strip 128*a* to the card 14*a*, the inner layer 132 is terminated short of the inner layer 134 at the top of the strip 128*a* to expose the inner layer 134, and it is the layer 134 which is then bonded to the vinyl material of the file card 14*a*.

The polyester utilized in the preferred embodiments is a strong, semi-rigid thermosetting sheet material. The polyvinyl material used for the file cards 14*a* is a semi-rigid sheet material often referred to in the trade as "rigid" in contrast to the soft, flexible vinyl used as shrink film or the like.

The strips 128 and 128*a* are relatively thin, on the order of approximately 0.003" in thickness, and have been found to possess excellent resilience, even after relatively long periods of storage in a compressed state.

If desired, the ends of the strips comprising the fulcrum means or spacing means can be adhered to the adjacent face of the file card by any suitable means.

The compressibility of the strips 54, 128 and 128*a* adapts them for use as spacing means between cards and as fulcrum means as well. In addition, as illustrated in FIG. 17, the compressibility of the strips allows data cards 14*b* to be pushed down past the strips to rest on the bottom wall of the file receptacle, if desired. In this instance the strips also serve as holding means to press the data cards 14*b* against the forward faces of the associated file cards 14*a*. Moreover, the holding action of the strips is effective even in the fanned open positions of the file cards, so that a desirable releasable gripping of the data cards 14*b* is present at all times.

The strips 54, 128 and 128*a* allow many more file and data cards to be compressed in a given space, thereby greatly increasing the storage capacity of the filing system in which they are used.

Various modifications and changes may be made with regard to the foregoing detailed description without departing from the spirit of the invention.

I claim:

1. A file card for use in adjacent relation with similar file cards one behind the other with data cards removably interposed between said file cards in a file receptacle, said file card comprising:

a sheet having top, bottom, and side edges and front and rear faces;

means on one face of said sheet and positioned along a fulcrum line at a location closer to said bottom edge than said top edge and spaced above said bottom edge for separating said one face of said sheet from an adjacent file card, thereby causing fanning apart of said top edges of said sheet and said adjacent file card upon movement of said bottom edges thereof toward one another; and means for automatically preferentially holding by attraction a readily removable data card against said front face of said sheet when said sheet and said adjacent file card are fanned apart.

2. A file card according to claim 1 including hold-down means formed on said sheet and engageable with said receptacle to constrain said file card against upward vertical movement during said fanning apart.

3. The file card of claim 2, wherein said hold-down means comprises a notch formed on said sheet.

4. The file card according to claim 1 wherein said means for automatically holding by attraction includes means on said sheet for developing a molecular adhesion to an adjacent data card and removably holding said data card against the face of said sheet opposite said face on which said separating means are located.

5. The file card according to claim 1 wherein said separating means comprises a protuberance formed on said one face of said sheet.

6. A file card according to claim 5 wherein said protuberance is embossed out of the material of said sheet.

7. The file card of claim 1 wherein said separating means comprises a plurality of dimples formed in and integral with said sheet which protrude toward said rear face of said sheet.

8. The file card according to claim 1 wherein said sheet is made of resilient material and wherein said separating means comprises a plurality of individual protuberances extending across the lower portion of the face of said sheet in spaced relation to one another, said protuberances of one of said file cards being located between said protuberances of an adjacent one of said file cards whereby said protuberances are adapted to resiliently deform the material of said sheet between said protuberances of said adjacent file card.

9. The file card according to claim 1 wherein said separating means comprises a continuous ridge along said fulcrum line.

10. A file card according to claim 1 wherein said sheet includes spacing means protruding from said face of said sheet above said separating means for generally equalizing the spacing between said face of said sheet relative to the face of an adjacent file card.

11. A file card according to claim 10 wherein said spacing means and said means for separating are resilient.

12. A file card according to claim 1 wherein said separating means is resilient.

13. A file card according to claim 1 wherein said file card includes means in the rear face of said sheet for pushing data cards, located above said separating means, during fanning against the front face of the next adjacent file card.

14. A file card according to claim 13 wherein said pushing means protrudes from said sheet above said separating means at a distance greater than the distance from which said separating means protrudes from said sheet.

15. A file card according to claim 13 wherein said separating means and said pushing means each comprise a horizontal row of individual protuberances, the horizontal spacing between the protuberances of said pushing means being greater than the horizontal spacing between the protuberances of said separating means.

16. A file card according to claim 1 wherein said separating means includes a continuous, relatively narrow strip of resilient material forming a continuous fulcrum across said lower portion of said one face of said sheet.

17. A file card according to claim 16 wherein said strip is flat sheet material deformed to project at its mid-portion from said one face of said sheet, attached at its upper portion to said one face, and freely slidable over said one face at its lower portion.

18. A file card according to claim 1 wherein said sheet includes spacing means protruding from said one face of said sheet from which said separating means protrudes, and adapted to space a microfiche data card away from said one face and break said attraction.

19. A file card according to claim 1 wherein the face of said sheet opposite said face from which said separating means protrudes is glossy to enhance the development of said attraction.

20. A file card according to claim 1 including hold-down means on said sheet for preventing said sheet from moving along its plane in a direction towards its top edge during fanning.

21. A file card according to claim 1 wherein said separating means is on said rear face of said sheet.

22. A file card according to claim 1 wherein said means for holding by attraction is on said front face of said sheet.

23. A file card according to claim 1 wherein the perimeter of said sheet is formed in a manner which permits said means for separating to lie below said data card within said receptacle.

24. A file card according to claim 1 wherein said separating means protrudes from said rear face of said sheet a distance substantially greater than the thickness of said data card thereby preserving the engagement between said separating means and the face of said adjacent file card when a data card is located on said front face above said separating means.

25. A file card according to claim 1 wherein said means for holding by attraction comprises means on said sheet for developing a molecular attraction to said data card.

26. A file card for use in adjacent relation with similar file cards one behind the other with data cards removably interposed between said file cards in a file receptacle, said file card comprising:

a sheet having top, bottom, and side edges and front and rear faces;

means on one face of said sheet and positioned along a fulcrum line at a location closer to said bottom edge than said top edge and spaced above said bottom edge for separating said one face of said sheet from an adjacent file card, thereby causing fanning apart of said top edges of said sheet and said adjacent file card upon movement of said bottom edges thereof toward one another; and means on the rear face of said sheet for pushing data cards during fanning against the front face of the next adjacent file card.

27. A file card according to claim 26 wherein said means for pushing data cards during fanning comprises spacing means protruding from said one face of said sheet from which said means for separating protrudes, and adapted to space a microfiche data card away from said face.

28. A file card according to claim 26 including hold-down means formed on said sheet and engageable with said receptacle to constrain said file card against upward vertical movement during said fanning apart.

29. The file card of claim 28, wherein said hold-down means comprise a notch formed on said sheet.

30. The file card according to claim 26 wherein said separating means comprises a protuberance formed on said one face of said sheet.

31. A file card according to claim 30 wherein said protuberance is embossed out of the material of said sheet.

32. The file card of claim 26 wherein said separating means comprises a plurality of dimples formed in and integral with said sheet which protrude toward said rear face of said sheet.

33. The file card according to claim 26 wherein said sheet is made of resilient material and wherein said separating means comprises a plurality of individual protuberances extending across the lower portion of the face of said sheet in spaced relation to one another, said protuberances of one of said file cards being located between said protuberances of an adjacent one of said file cards whereby said protuberances are adapted to resiliently deform the material of said sheet between said protuberances of said adjacent file card.

34. The file card according to claim 26 wherein said separating means comprises a continuous ridge along said fulcrum line.

35. A file card according to claim 26 wherein said sheet includes spacing means protruding from said face of said sheet above said separating means for generally equalizing the spacing between said face of said sheet relative to the face of an adjacent file card.

36. A file card according to claim 35 wherein said spacing means and said means for separating are resilient.

37. A file card according to claim 26 wherein said separating means is resilient.

38. A file card according to claim 26 wherein said separating means includes a continuous, relatively narrow strip of resilient material forming a continuous fulcrum across said lower portion of said one face of said sheet.

39. A file card according to claim 38 wherein said strip is flat sheet material deformed to project at its mid-portion from said one face of said sheet, attached at its upper portion to said one face, and freely slidable over said one face at its lower portion.

40. A file card according to claim 26 including hold-down means on said sheet for preventing said sheet from moving along its plane in a direction towards its top edge during fanning.

41. A file card according to claim 26 wherein said separating means is on said rear face of said sheet.

42. A file card according to claim 26 wherein the perimeter of said sheet is formed in a manner which permits said means for separating to lie below said data card within said receptacle.

43. A file card according to claim 26 wherein said separating means protrudes from said rear face of said sheet a distance substantially greater than the thickness of said data card thereby preserving the engagement between said separating means and the face of said adjacent file card when a data card is located on said front face above said separating means.

* * * * *